US010252226B2

(12) United States Patent
Milligan

(10) Patent No.: US 10,252,226 B2
(45) Date of Patent: Apr. 9, 2019

(54) SYSTEMS AND METHODS FOR DISSOLVING A GAS INTO A LIQUID

(71) Applicant: BlueInGreen LLC, Fayetteville, AR (US)

(72) Inventor: Christoper B. Milligan, Fayetteville, AR (US)

(73) Assignee: BlueInGreen LLC, Fayetteville, AR (US)

( * ) Notice: Subject to any disclaimer, the term of this patent is extended or adjusted under 35 U.S.C. 154(b) by 659 days.

(21) Appl. No.: 14/698,248

(22) Filed: Apr. 28, 2015

(65) Prior Publication Data

US 2015/0314247 A1 Nov. 5, 2015

Related U.S. Application Data

(60) Provisional application No. 61/984,996, filed on Apr. 28, 2014.

(51) Int. Cl.
*B01F 1/00* (2006.01)
*B01F 3/04* (2006.01)
(Continued)

(52) U.S. Cl.
CPC ..... *B01F 3/0412* (2013.01); *B01F 1/00* (2013.01); *B01F 1/0038* (2013.01);
(Continued)

(58) Field of Classification Search
CPC .. B01F 3/0446; B01F 1/00; B01F 2003/0412; B01F 3/04836; B01F 13/065; B01F 15/026; B01F 15/00357
(Continued)

(56) References Cited

U.S. PATENT DOCUMENTS 3,772,187 A 11/1973 Othmer
4,070,279 A 1/1978 Armstrong
(Continued)

FOREIGN PATENT DOCUMENTS

WO WO-2012103602 A1 8/2012

OTHER PUBLICATIONS

International Preliminary Report on Patentability and Written Opinion of the International Searching Authority dated Nov. 1, 2016 in corresponding International Application No. PCT/US2015/028005.
(Continued)

*Primary Examiner* — Mark Halpern
(74) *Attorney, Agent, or Firm* — McCarter & English, LLP; David J. Silvia

(57) ABSTRACT

In accordance with at least one aspect of this disclosure, a system for dissolving gases into a liquid without side-stream pumping includes a pressure vessel defining a liquid inlet and a liquid outlet, a gas inlet device disposed within an internal chamber of the pressure vessel, a gas source in selective fluid communication with the gas inlet device and the internal chamber of the pressure vessel through a gas control valve and configured to provide a gas pressure, a liquid inlet pipe in selective fluid communication with the liquid inlet of the pressure vessel through a liquid inlet valve, and an outlet pipe in selective fluid communication with the liquid outlet through a liquid outlet valve for discharging the liquid from the internal chamber of the pressure vessel. The gas pressure both facilitates the dissolving of the gas in the liquid and forces the liquid out of the pressure vessel when the liquid is exposed to the gas pressure.

15 Claims, 10 Drawing Sheets

(51) Int. Cl.
*B01F 15/00* (2006.01)
*B01F 15/02* (2006.01)
*B01F 13/06* (2006.01)

(52) U.S. Cl.
CPC ..... *B01F 3/0446* (2013.01); *B01F 3/04836* (2013.01); *B01F 13/065* (2013.01); *B01F 15/0035* (2013.01); *B01F 15/00357* (2013.01); *B01F 15/00402* (2013.01); *B01F 15/026* (2013.01); *B01F 2003/04127* (2013.01)

(58) Field of Classification Search
USPC ..... 366/144, 153.1, 163.1, 151.1; 261/59, 261/74, 34.1
See application file for complete search history.

(56) References Cited

U.S. PATENT DOCUMENTS

| | | | |
|---|---|---|---|
| 4,171,263 | A | 10/1979 | Roberts, Jr. et al. |
| 4,271,099 | A | 6/1981 | Kukla |
| 4,337,152 | A | 6/1982 | Lynch |
| 4,466,928 | A | 8/1984 | Kos |
| 4,965,022 | A | 10/1990 | Litz |
| 5,049,320 | A | 9/1991 | Wang et al. |
| 5,108,662 | A | 4/1992 | Litz et al. |
| 5,437,785 | A | 8/1995 | Roshanravan |
| 5,514,267 | A | 5/1996 | Machiya et al. |
| 6,464,210 | B1 | 10/2002 | Teran et al. |
| 6,485,003 | B2 | 11/2002 | Speece |
| 6,668,556 | B2 | 12/2003 | Speece |
| 7,163,632 | B1 | 1/2007 | Speece |
| 7,255,332 | B2 | 8/2007 | Osborn et al. |
| 8,567,767 | B2 | 10/2013 | Fantappie |
| 2010/0110824 | A1 | 5/2010 | Hirata et al. |
| 2012/0228396 | A1 | 9/2012 | Osborn et al. |
| 2012/0228404 | A1 | 9/2012 | Richardson |
| 2013/0229889 | A1 | 9/2013 | Osborn et al. |

OTHER PUBLICATIONS

"How High Ozone Concentration Makes it Easier to Dissolve Ozone in Water" Insights from Industry, A. Golshenas, http://www.azom.com/article.aspx?ArticleID=10718, 4 pages.

"Optimizing Mass-Transfer of Ozone Gas into Aqueous Solutions", B. Hamil, May 6, 2011. o3info@delozone.com www.delozone.com. 3 pages.

Henry's Law

P = Kh * C

| | | | | |
|---|---|---|---|---|
| | P, atm | 6.80 | P, psi | 100.00 |
| @ 25C | Kh, L*atm/mol | 769.23 | Kh, L*psi/n | 0.35 |
| | C, mol/L | 0.0088 | C, mg/L | 283.07 |
| | MW, g/mol | 32.00 | | |

| Pressure (psi) | Concentration (mg/L) |
|---|---|
| 0 | 0 |
| 25 | 71 |
| 50 | 142 |
| 75 | 212 |
| 100 | 283 |
| 125 | 354 |
| 150 | 425 |
| 175 | 495 |
| 200 | 566 |
| 225 | 637 |
| 250 | 708 |
| 275 | 778 |
| 300 | 849 |

SYSTEMS AND METHODS FOR DISSOLVING A GAS INTO A LIQUID

CROSS-REFERENCE TO RELATED APPLICATIONS

This application claims the benefit of and priority to U.S. Provisional Patent Application No. 61/984,996, filed on Apr. 28, 2014, the entire contents of which are incorporated herein by reference.

BACKGROUND

1. Field of the Disclosure

This disclosure is directed to economical systems and methods for facilitating the control of dissolution of one or more gases into a liquid with little to no external energy input.

2. Background of Related Art

Many different systems and methods, depending on application, are available for dissolving gases in liquids. Some of the main applications are in the areas of water and wastewater treatment for municipal, commercial, and industrial uses; aquaculture; ground water remediation; ecological restoration and preservation; beverage making and bottling, and agriculture. Most dissolved gas delivery methods (i.e. bubble diffusion, Venturi injection, U-tubes, Speece cones) attempt to leverage Henry's Law to achieve a high concentration of dissolved gas in the carrier stream. These typically require high flow and/or high pressure from side-stream pumping in order to achieve high rates of gas dissolution.

Higher operating pressures lead to higher gas concentrations; however, this must be balanced with higher operating costs associated with achieving higher pressures. While there are variations between existing technologies operating parameters, all technologies requiring side-stream pumping operate under the same physical laws. Generally, these technologies create a large gas/liquid interface and subject it to elevated pressures for a period of time, subsequently increasing dissolved gas concentration within the liquid. All ultimately require that the gas and the liquid be in contact at the desired pressure.

Certain technologies provide energy input into the liquid and/or gas (e.g., via pumping) to achieve desired vessel pressure. Some technologies provide energy input into the liquid, with an additional energy added, such that a venturi injector can be utilized to create a vacuum allowing the gas to enter without additional energy input from the gas source.

Through algebraic manipulation, an equation can be developed for the efficiency of any side-stream saturation device, in terms of mass/time/energy (lb/d/hp).

E=(1/694.444*((P/Kh)*(s/100))*8.34)/(1*((P+L)*2.3097)/3960/(i/100)). As seen above, this equation only considers the following: Side-stream pressure requirement (P, psi), Henry's Law Constant (Kh, L*psi/mg), Percent of Saturation Achieved (s, %), Headloss Across System (L, psi), and Pump Efficiency (I, %).

For the purposes of discussion here, oxygen will be the gas of choice. However, those skilled in the art will readily recognize the method/apparatus disclosed here can be applied to any gas/liquid dissolution combination. Supplement 1 (with reference to FIG. 8) appended hereto shows the effect of pressure on dissolved gas concentration, as per Henry's Law. The effect of side-stream pumping and associated system headloss can be seen in Supplement 2 (as shown in FIG. 9) appended hereto. Based on the listed assumptions, the maximum efficiency of these systems can be seen for various pressure drop values where a maximum possible is about 58-lb/d/hp. Reducing system pressure loss will greatly impact the overall efficiency especially at pressures below about 100-psi.

The effect of side-stream pumping and associated pump efficiencies can be seen in Supplement 3 (as shown in FIG. 10) appended hereto. Pumps are not extremely efficient and become less efficient with larger solids handling capabilities. Based on the listed assumptions, the maximum efficiency of these systems can be seen for various pressure drop values where a maximum possible is about 41-lb/d/hp, or about 30% less than theoretical (Supplement 2 as shown in FIG. 9).

Supplement 4 appended hereto shows total energy requirements, side-stream pumping plus gas generation, for various oxygen dissolution technologies and approaches, as well as that of embodiments of the system disclosed herein. As can be seen, eliminating side-stream pumping requirements reduces the overall power consumption by about 60%.

For the most part, existing technologies involve side-stream pumping and either pressurized gas sources or gas sources under vacuum. While higher operating pressures lead to higher gas concentrations, to achieve these higher pressures, higher costs are involved.

Therefore, a simplified, low cost, method for dissolving a gas into a liquid, preferably while also maintaining a particular constant flow rate of said liquid is needed. Embodiments of this disclosure can eliminate the requirement for side-stream pumping and greatly reduces operating cost of side-stream gas dissolution systems.

SUMMARY

Embodiments of this disclosure are directed to simple and economical systems and methods for facilitating the control of dissolution of one or more gases into a liquid, such as water, without external energy output. Gases for use with the disclosed systems and methods include, e.g., air, oxygen, ozone, and carbon dioxide. However, those skilled in the art will readily recognize the applicability of any suitable gas. Certain applications include, for example, treatment of process basins, pipes and piping systems, rivers, streams, lakes, and ponds, in municipal, industrial, or natural settings.

More specifically, embodiments of this disclosure are directed to systems for gas dissolution into a liquid that include, inter alia, a dissolution tank assembly that has a pressure vessel, source of pressurized gas, and control valves capable of dissolving the pressurized gas into the liquid at elevated pressures. The dissolution tank also includes at least one liquid control valve that permits passage of the fluid into and out of the vessel; said outlet fluid having a desired gas concentration from the pressure vessel. Embodiments of systems of this disclosure further include a gas source in communication with the vessel and a gas supply header and gas supply piping. Also provided is a gas inlet device for generating a large gas/liquid interface area. The saturated liquid is expelled through the liquid flow control valve and inlet/outlet piping. A device for venting stripped and/or undissolved gas is provided as a means of controlling multiple concentrations in the liquid and gas phases.

In certain embodiments, a method includes recapturing the energy associated with motive force of the entering and exiting water. Embodiments of this disclosure include separate inlet and outlet flow control valves and an energy recovery device, such as a micro-turbine.

Certain embodiments makes use of multiple vessels in a series with a combination of interconnected valves, piping, and appurtenances to provide a more consistent output. Embodiments of this disclosure can include a series of high and low pressure manifolds and associated valves such that the gas headspace in one vessel can be vented to another vessel allowing for greater flexibility in operations and ensuring maximum utilization of produced gases. Additionally, in such embodiments, excess gas under low pressure can be added to vessel discharge utilizing venturi principles.

An additional embodiment employs the energy recovery device in combination with the plurality of vessels. This embodiment provides consistent output and increases the overall system efficiency.

In accordance with at least one aspect of this disclosure, a system for dissolving gases into a liquid without side-stream pumping includes, inter alia, a pressure vessel defining an internal chamber configured to hold a liquid and to provide a gas head space above the liquid. The pressure vessel can define a liquid inlet and a liquid outlet. A gas inlet device can be disposed within the internal chamber of the pressure vessel and can be configured to allow gas to enter the pressure vessel. A gas source can be in selective fluid communication with the gas inlet device and the internal chamber of the pressure vessel through a gas control valve to supply a gas to the pressure vessel. The gas source is configured to provide a gas pressure. A liquid inlet pipe can be in selective fluid communication with the liquid inlet of the pressure vessel through a liquid inlet valve. An outlet pipe can be in selective fluid communication with the liquid outlet through a liquid outlet valve for discharging the liquid from the internal chamber of the pressure vessel. The gas pressure both facilitates the dissolving of the gas in the liquid and forces the liquid out of the pressure vessel when the liquid is exposed to the gas pressure.

The gas inlet device can be configured to introduce pressurized gas into the liquid. The surface area of the gas inlet device can be at least half of the surface area of a bottom of the pressure vessel or any other suitable surface area.

The system can further include an energy recovery device. The energy recovery device can be a micro-turbine, for example.

In certain embodiments, the outlet pipe and the inlet pipe can be the same pipe and the liquid inlet valve and the liquid outlet valve can be the same valve.

The system can further include plurality of pressure vessels connected in a series and configured to supply a constant flow output. Moreover, the system can include an energy recovery device connected to at least one of the plurality of pressure vessels.

It is envisioned that in certain embodiments, the system can further include a control system. The control system can be configured to open the liquid inlet valve to allow liquid to flow into the internal chamber until a first predetermined condition occurs, open the gas control valve after closing the liquid inlet valve to pressurize the internal chamber with the gas until a second predetermined condition occurs, and open the liquid outlet valve to effuse the liquid from the internal chamber. The control system can include any suitable electronics, hardware, software, or the like as is understood by those skilled in the art.

The first predetermined condition can include, for example, at least one of a time or a fill level of the internal chamber. The second predetermined condition can include, for example, at least one of a time, a pressure of the internal chamber, a dissolution rate of the gas into the liquid, or a gas content of the liquid.

Embodiments of the system can include a venturi disposed in fluid communication with the liquid outlet pipe and configured to add the gas from the gas head space to an outlet flow.

In accordance with at least one aspect of this disclosure, embodiments of the disclosed system can include a floating vessel including a submerged portion configured to sit below a water level of a body of water, and a pressure vessel as described herein disposed within the submerged portion.

In certain embodiments, the gas source can also be disposed within the submerged portion of the floating vessel. The submerged portion can connect the liquid inlet of the pressure vessel to the body of water.

In accordance with at least one aspect of this disclosure, a method for dissolving a gas into a liquid without pumping can include opening a liquid inlet valve to allow a liquid to flow into an internal chamber of a pressure vessel until a first predetermined condition occurs, opening a gas control valve in fluid communication with a gas source after closing the liquid inlet valve to pressurize the internal chamber with a gas of the gas source until a second predetermined condition occurs, and opening the liquid outlet valve to effuse the liquid from the internal chamber.

These and other features and benefits of the embodiments of this disclosure and the manner in which it is assembled and employed will become more readily apparent to those having ordinary skill in the art from the following enabling description of embodiments of this disclosure taken in conjunction with the drawings described below.

BRIEF DESCRIPTION OF THE DRAWINGS

So that those skilled in the art to which the subject invention appertains will readily understand how to make and use embodiments of the systems and methods of this disclosure without undue experimentation, preferred embodiments thereof will be described in detail herein below with reference to certain figures, wherein:

FIG. 5 is a schematic diagram showing an embodiment of a land based installation scheme wherein inlet feed pressure is provided from existing water level in a tank, basin, and/or the like;

These and other aspects of the subject invention will become more readily apparent to those having ordinary skill in the art from the following detailed description of the invention taken in conjunction with the drawings.

DETAILED DESCRIPTION OF PREFERRED EMBODIMENTS

Disclosed herein are detailed descriptions of specific embodiments of the systems and methods of the present invention for dissolving a gas into a liquid without the use of external energy input. It will be understood that the disclosed embodiments are merely examples of ways in which certain aspects of the invention can be implemented and do not represent an exhaustive list of all of the ways the invention may be embodied. Indeed, it will be understood that the systems, devices, and methods described herein may be embodied in various and alternative forms. The Figures are not necessarily to scale and some features may be exaggerated or minimized to show details of particular components. Well-known components, materials, or methods are not necessarily described in great detail in order to avoid obscuring the present disclosure.

Figures illustrating the components show some elements that are known and will be recognized by one skilled in the art. The detailed descriptions of such elements are not necessary to an understanding of the invention, and accordingly, are herein presented only to the degree necessary to facilitate an understanding of the novel features of the present invention.

A method is disclosed herein that allows an operator to manipulate the dissolution of a gas into a liquid without using any external energy input. The available atmospheric pressure is sufficient when a liquid control value is opened, allowing the liquid to flow into the pressurized vessel.

As will be described herein below, an embodiment of a method used to increase gas transfer within the vessel involves opening a liquid control valve such that liquid flows via available atmospheric pressure into the pressure vessel, without any external energy input. Once the desired liquid level is achieved, a liquid control valve closes and the gas control valve is opened. The gas flows into the pressure vessel at a rate dictated by the pressurized gas source. As pressure in the vessel increases toward the regulated pressure of the gas source, dissolved gas concentrations within the liquid increase proportionally according to Henry's Law. After a predetermined pressure or time has been achieved, the gas supply control valve is closed and the liquid control valve is opened. The elevated pressure within the vessel provides energy required to expel the saturated liquid through the liquid flow control valve.

Figure 1:
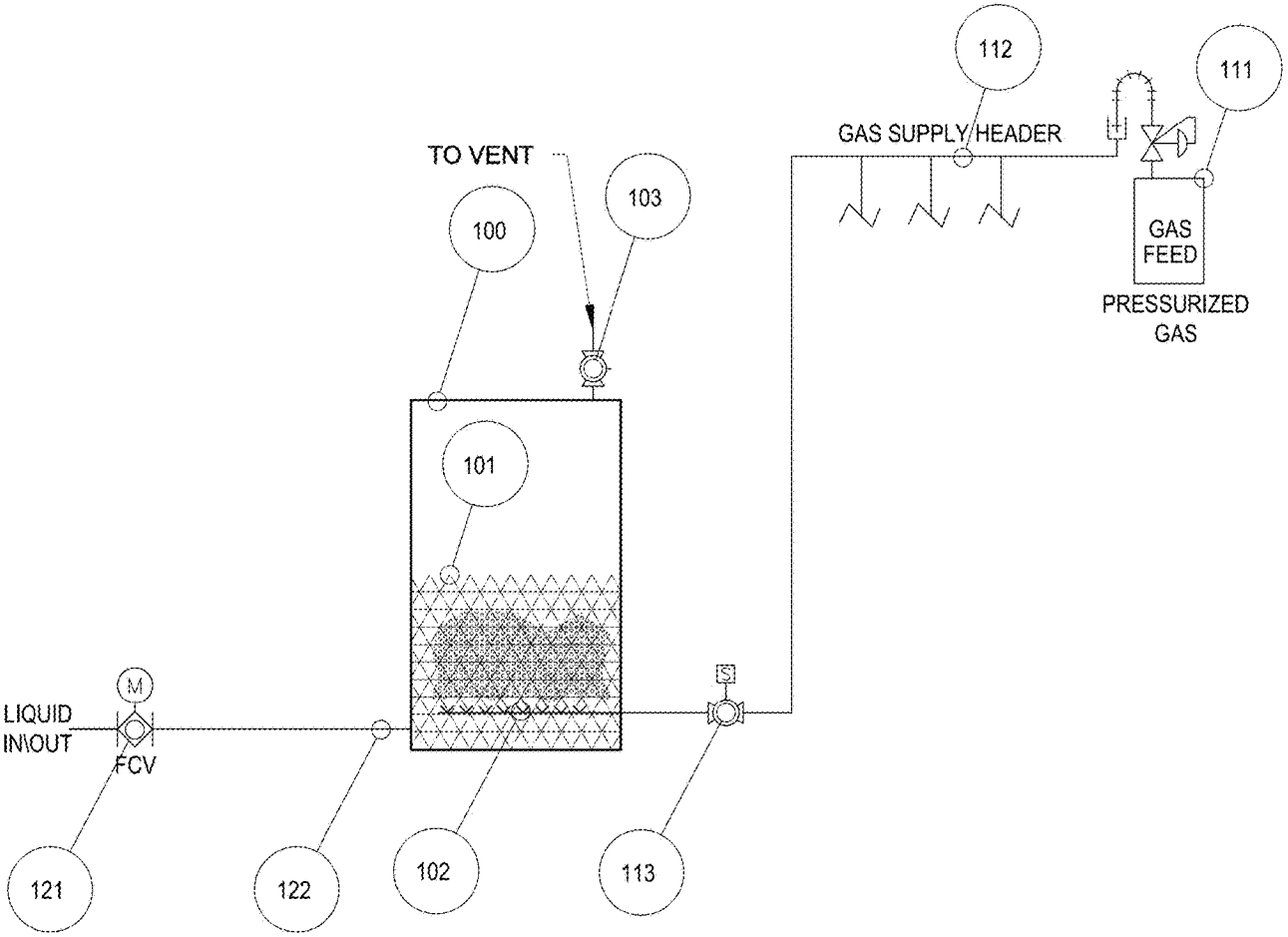
FIG. 1 is a schematic diagram illustrating an embodiment of this disclosure including a pressure vessel, a source of pressurized gas, and control valves capable of efficiently dissolving the pressurized gas into the liquid at elevated pressures.

Referring now to FIG. 1, which illustrates a system for dissolving gases in a fluid which has been constructed in accordance with an embodiment of this disclosure. A gas dissolution method/apparatus including a pressure vessel 100, includes, inter alia, a source of pressurized gas 111, and control valves 121 and 113 capable of efficiently dissolving the pressurized gas 111 into liquid 101 at elevated pressures. A liquid control valve 121 is opened and liquid flows through inlet/outlet piping 122 via available atmospheric or liquid head pressure, into a pressure vessel 100, without external energy input. Once the desired liquid level is achieved 101, the liquid control valve 121 closes. Gas control valve 113 is opened and gas flows into pressure vessel 100 via gas supply piping 112 at a rate dictated by pressurized gas source 111. Gas is introduced to the pressure vessel 100 via gas inlet device 102, preferably capable of generating a large gas/liquid interface area. As pressure in the vessel 100 increases toward the regulated pressure of the gas source 111, dissolved gas concentrations within the liquid 101 increase proportionally according to Henry's Law. After a predetermined pressure, or time, has been achieved, gas supply control valve 113 is closed and liquid control valve 121 is opened. The elevated pressure within the vessel provides energy required to expel the saturated liquid through the liquid flow control valve 121 and inlet/outlet piping 122. Those skilled in the art will readily recognize that multiple pressure vessels 100 can be operated simultaneously from a single pressurized gas source 111 and 112. Additionally, due to the stripping potential of gas bubbles within the liquid 101, in some cases, it will be advantageous to provide venting capabilities 103 such that stripped and/or undissolved gases can be readily removed from the system. The operation of the vent valve 103 can be utilized to optimize system performance and control concentrations of various gases within the liquid and within the gas headspace.

Figure 2:
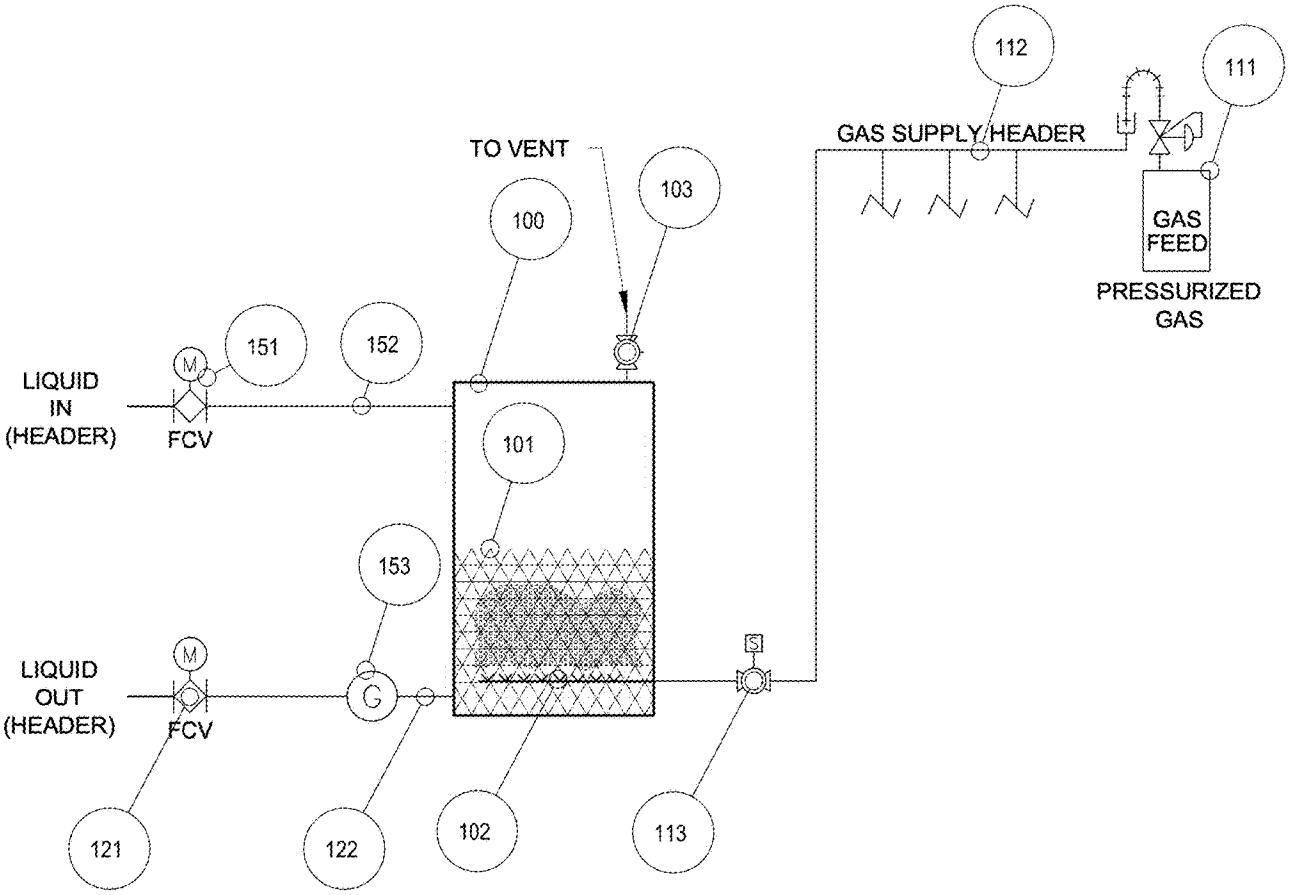
FIG. 2 is a schematic diagram of an embodiment of this disclosure whereby the inlet/outlet piping may include an energy recovery device, such as a micro-turbine, to recapture energy associated with motive force of the entering/exiting water.

As shown in FIG. 2, the inlet/outlet piping 122 may include an energy recovery device 153, such as a microturbine, to re-capture energy associated with motive force of the entering/exiting water. Because the system utilizes minimal available pressure to fill the pressure vessel 100, and because the energy recovery device 153 can have some associated pressure loss, separate inlet and outlet flow control valves 151, 152 and piping 121, 122 can be provided in order to minimize required fill time and/or inlet and outlet piping sizes.

Figure 3:
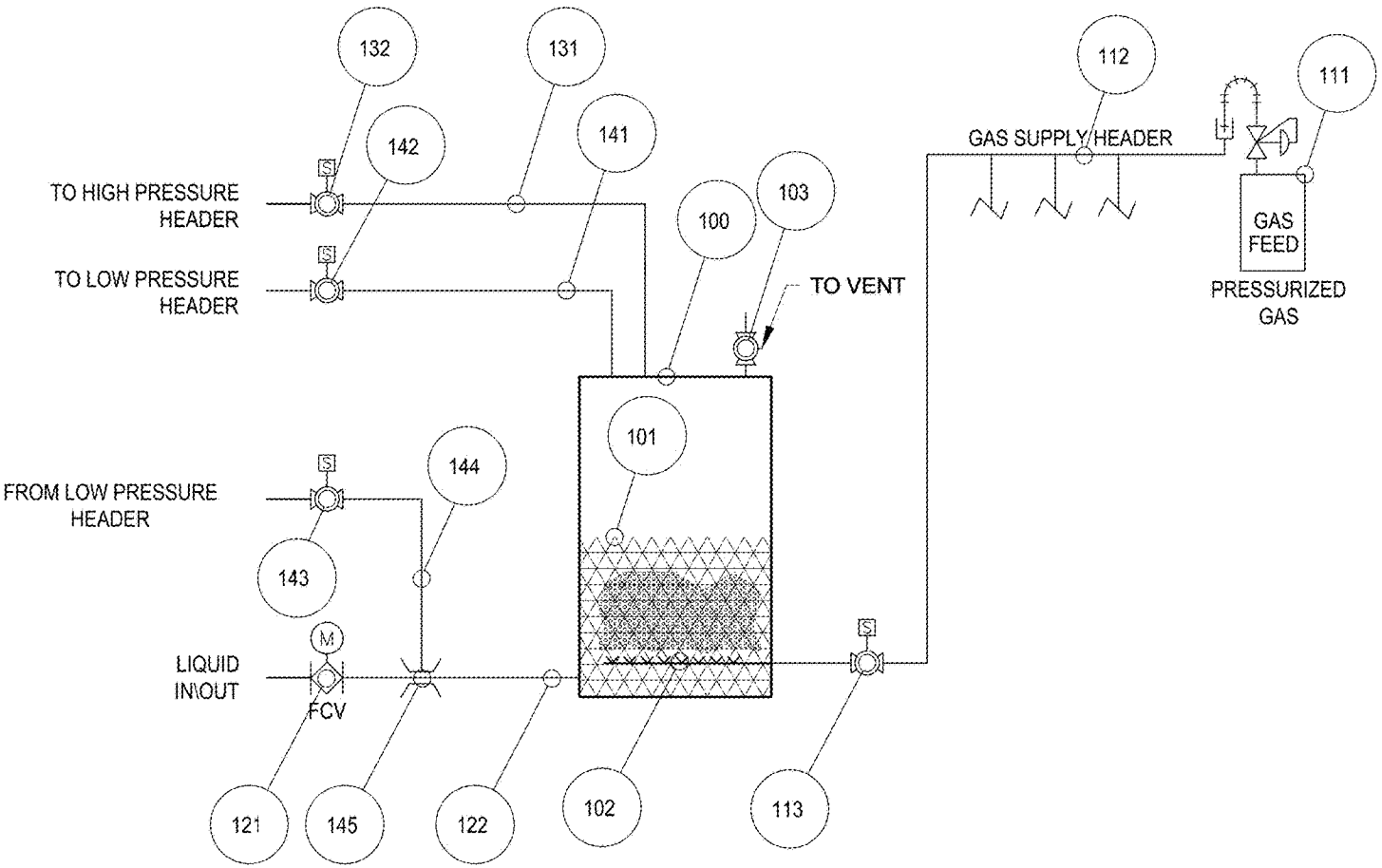
FIG. 3 is a schematic diagram showing multiple pressure vessels in series and a combination of interconnected valves, piping, and appurtenances.

FIG. 3 shows an alternate embodiment, where gas utilization can be increased and dissolved gas delivery made more consistent through the use of multiple pressure vessels in series and a combination of interconnected valves, piping, and appurtenances. After filling and pressurizing the vessel 100, outlet valve 121 opens such that liquid rich in dissolved gas 101 begins to exit. At this point, the pressure in the vessel is still at maximum. Excess gas, at these high pressures, can be directed from the discharging pressure vessel to another filling vessel via high pressure outlet control valve 132 and piping 131. Once the pressure drops to a given level, a similar approach can be used for excess gas available at low pressures via low pressure outlet control valve 142 and piping 141. Additionally, excess gas under low pressure can be added to vessel discharge via low pressure inlet control valve 143 and piping 144, utilizing venturi principles 145.

Figure 4:
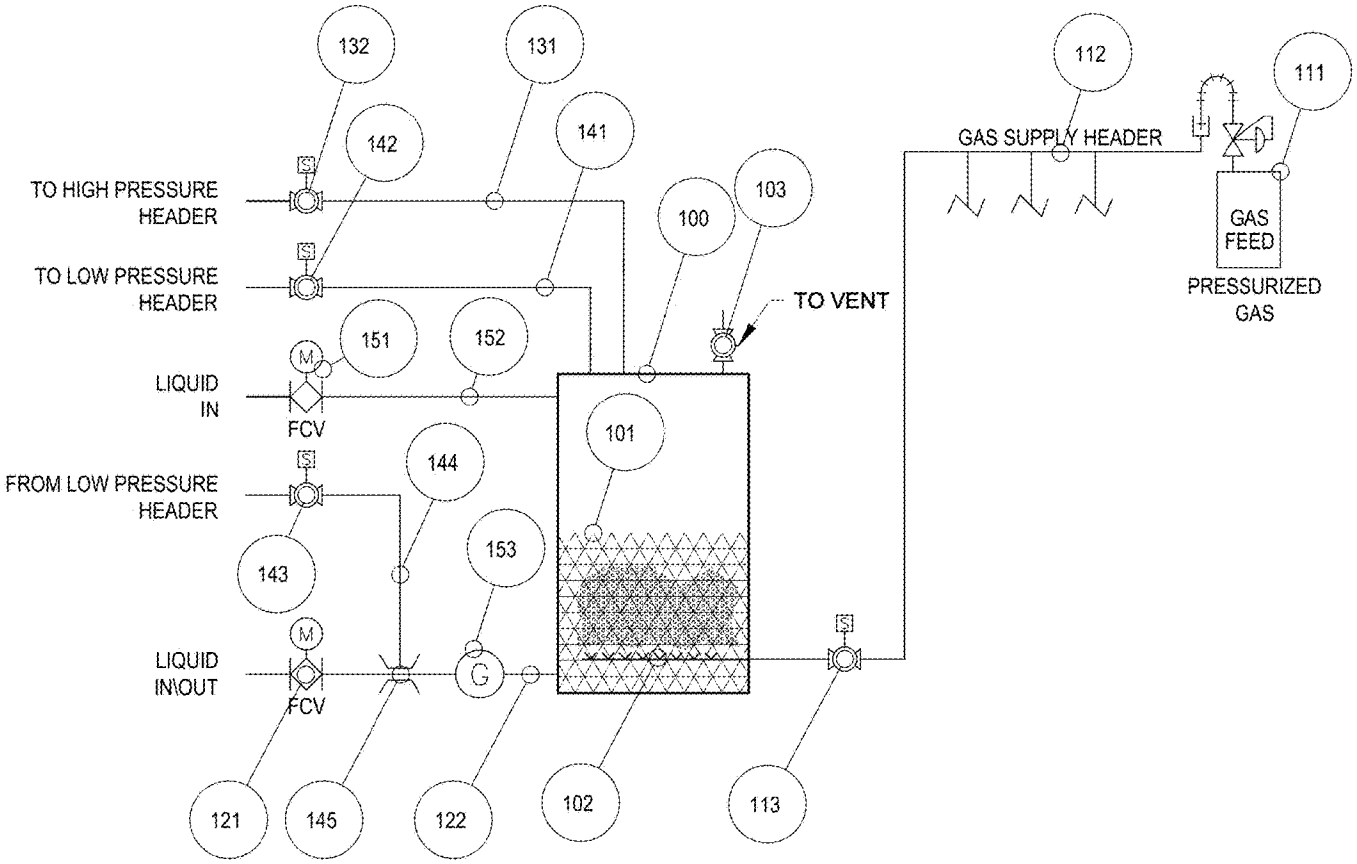
FIG. 4 is a schematic diagram showing an energy recovery device used in combination with a plurality of vessels to provide consistent output and increase overall system efficiencies.

FIG. 4 shows an alternate embodiment, whereby energy recovery devices 153 can be used in combination with one or more of a plurality of vessels 100 as disclosed hereinabove, thus providing consistent output and increasing overall system efficiencies.

Figure 5:
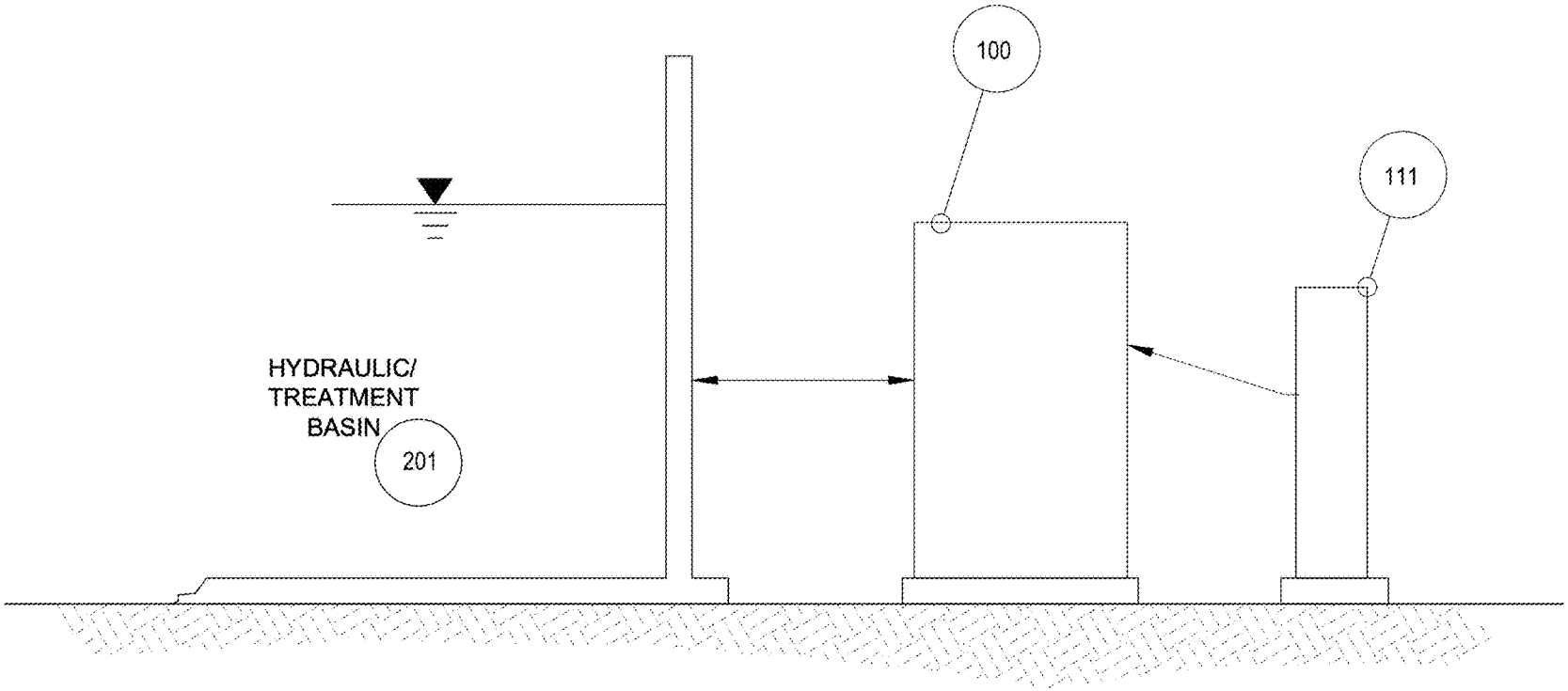
Figure 6:
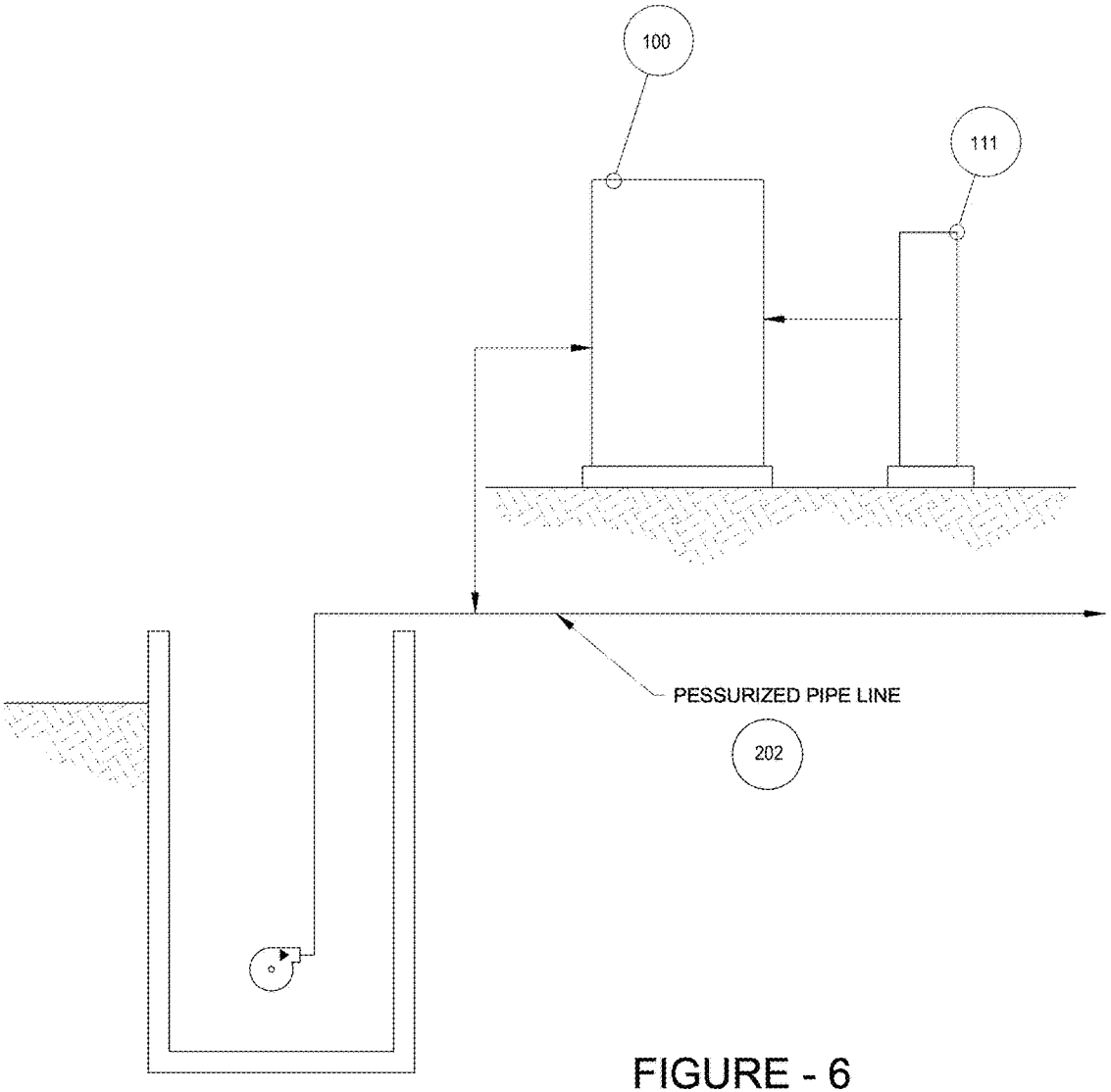
FIG. 6 is a schematic diagram showing an embodiment of an installation scheme wherein inlet feed pressure is provided from pressurized pipeline.

Embodiments of this disclosure can be applied to any suitable installation scheme, such as embodiments thereof shown in FIGS. 5, 6, and/or 7. For example, FIG. 5 depicts an installation scheme where inlet feed pressure is provided from existing water level in a container vessel 201 (e.g., a tank, basin, or the like). In some cases, equipment may be able to be installed at grade but in other instances, this set-up can require vaulting of the equipment.

FIG. 6 depicts an alternate installation scheme whereby inlet feed pressure is provided from pressurized pipeline 202 which is pressurized using any suitable means (e.g., a pump). Installation can be at grade, assuming there is adequate pressure, or vaulted based on project constraints.

Figure 7:
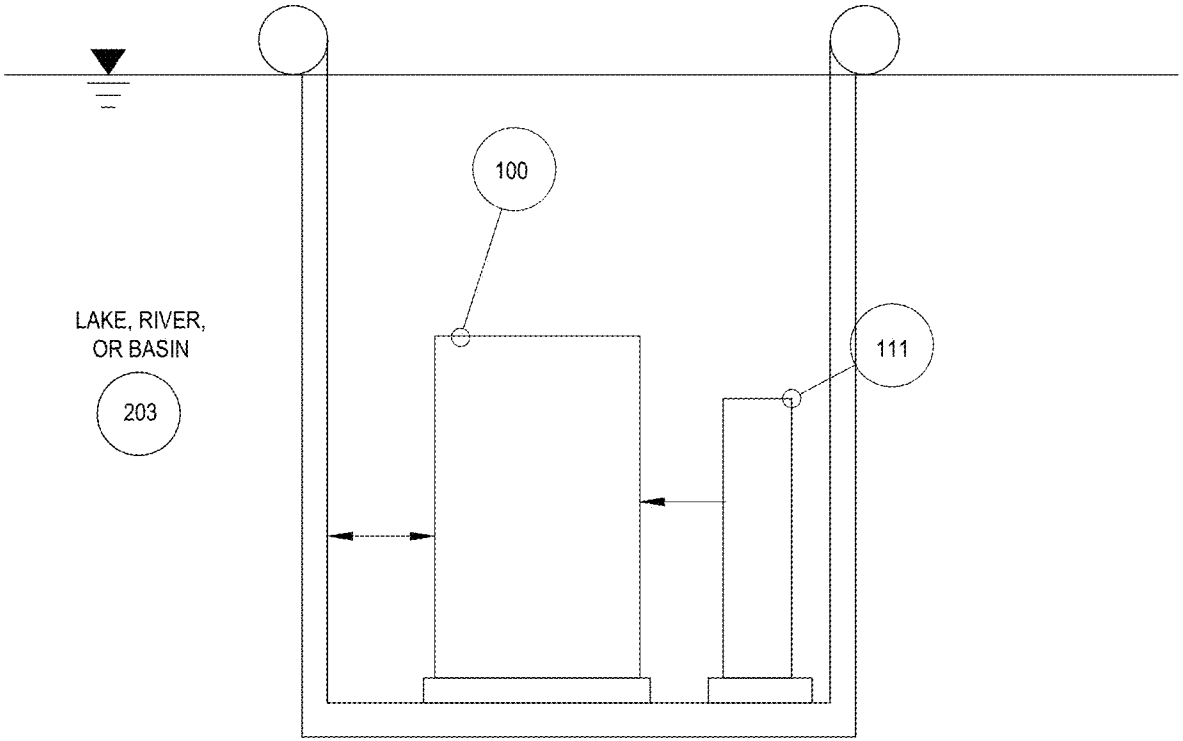
FIG. 7 is a schematic diagram showing an embodiment of an installation scheme wherein inlet feed pressure is provided from existing water level in a body of water, shown including a floating vessel providing for mobile, in-situ treatment of the body of water.

FIG. 7 depicts yet another embodiment of an installation scheme where inlet feed pressure is provided from existing water level in a body of water 203 (e.g., lake, river, basin, or the like). In contrast to the land based installation scheme of FIG. 5, the embodiment of an installation scheme as shown in FIG. 7 can include a floating container, providing for mobile, in-situ treatment of the body of water 203. As shown, the water can be fed in to the vessel 100 from the body of water 203, pressurized using the gas source 111, and then evacuated above, at, and/or below the water level of the body of water 203 using only the pressurization from the gas source 111.

Embodiments of this disclosure may be operated with a plurality of pressure vessels 100 to provide for continuous output and/or to ensure full utilization of produced gas. Supplement 5, below, shows examples of system sizing and batch operation scheduling designed to provide continuous output of dissolved gas. Supplement 5.1a and Supplement 5.2a show sizing calculations for a reactor with the exact same properties in height, diameter, area, and volume. The difference can be seen in the inlet diameter and the gas flow. Supplement 5.1b and 5.2b demonstrate how batching operations for the designs shown in Supplements 5.1a and 5.2a could operate to produce consistent output.

The logic behind the design of the present invention is that gas dissolution will always require a gas supply. To achieve rapid and efficient gas dissolution elevated pressures are required. Industrial gases can be provided in gaseous or liquid form under pressure. Higher pressures are available at no additional cost. These industrial gases can also be generated on-site. Due to advancements in gas generation technologies, high pressure is available at a small incremental cost.

Gas dissolution does not necessarily require side-stream pumping. The present invention utilizes available liquid head to fill a pressure vessel with liquid, then utilizes available pressure from gas storage tanks, or on-site generators, to not only supply gas requirements, but to also provide energy required for vessel pressurization and motive force required to empty the vessel.

While the subject invention has been described with respect to certain embodiments disclosed above, those skilled in the art will readily appreciate that changes and modifications may be made thereto without departing from the spirit and scope of the this disclosure as defined by the appended claims.

Supplement 1

Effects of Pressure on Dissolved Gas Concentrations (Oxygen Example)

Figure 8:
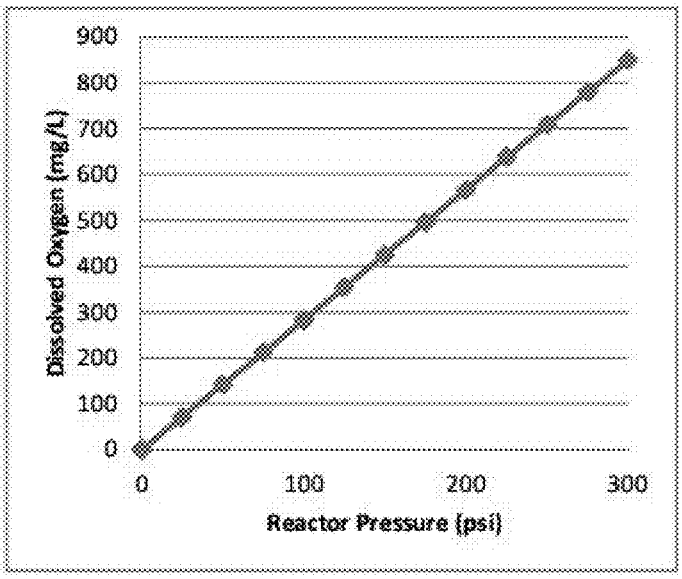
FIG. 8 is a chart showing dissolved oxygen versus reactor pressure in conjunction with Supplement 1.
Figure 9:
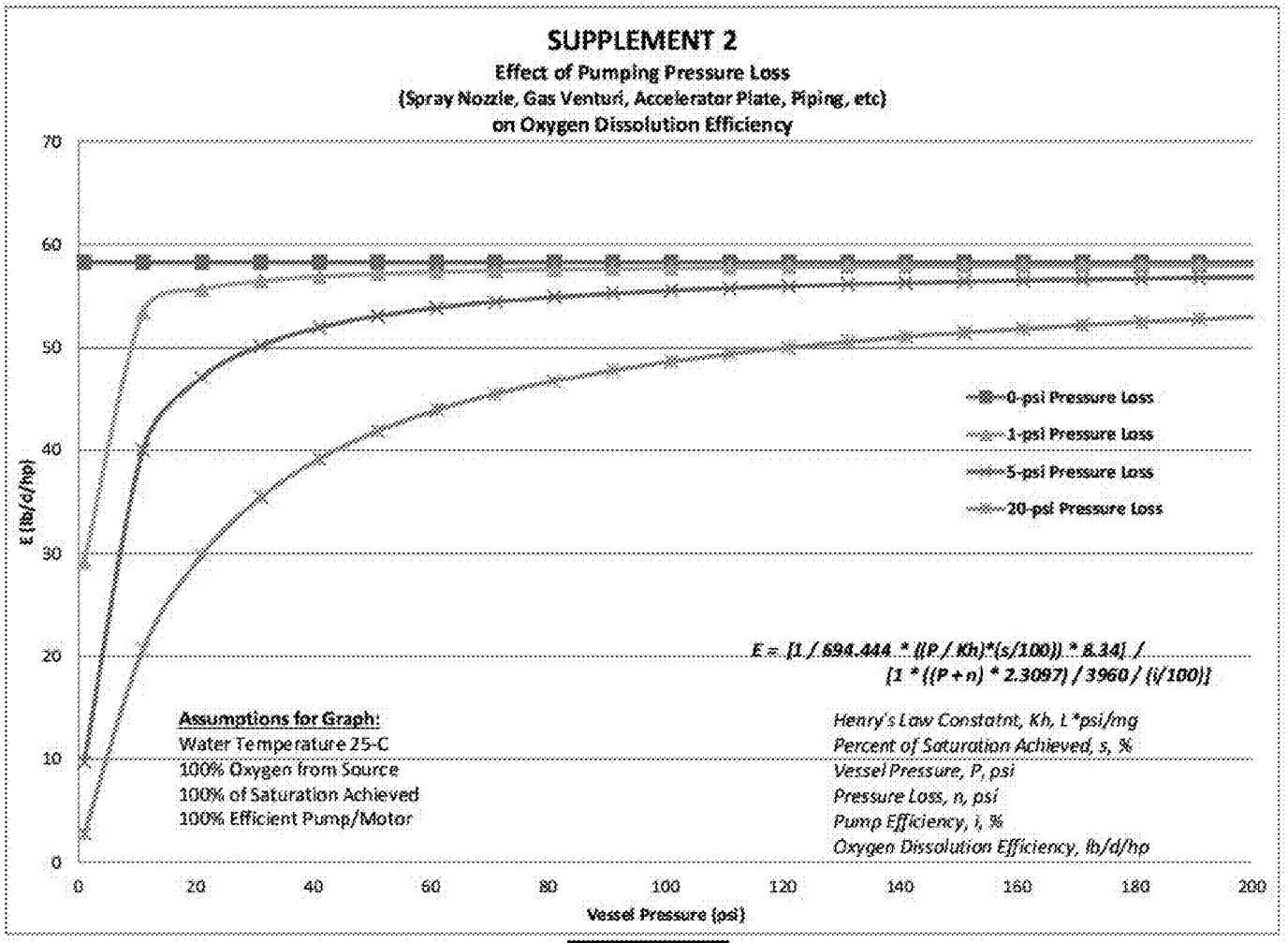
FIG. 9 is a chart showing the effect of pump pressure loss.
Figure 10:
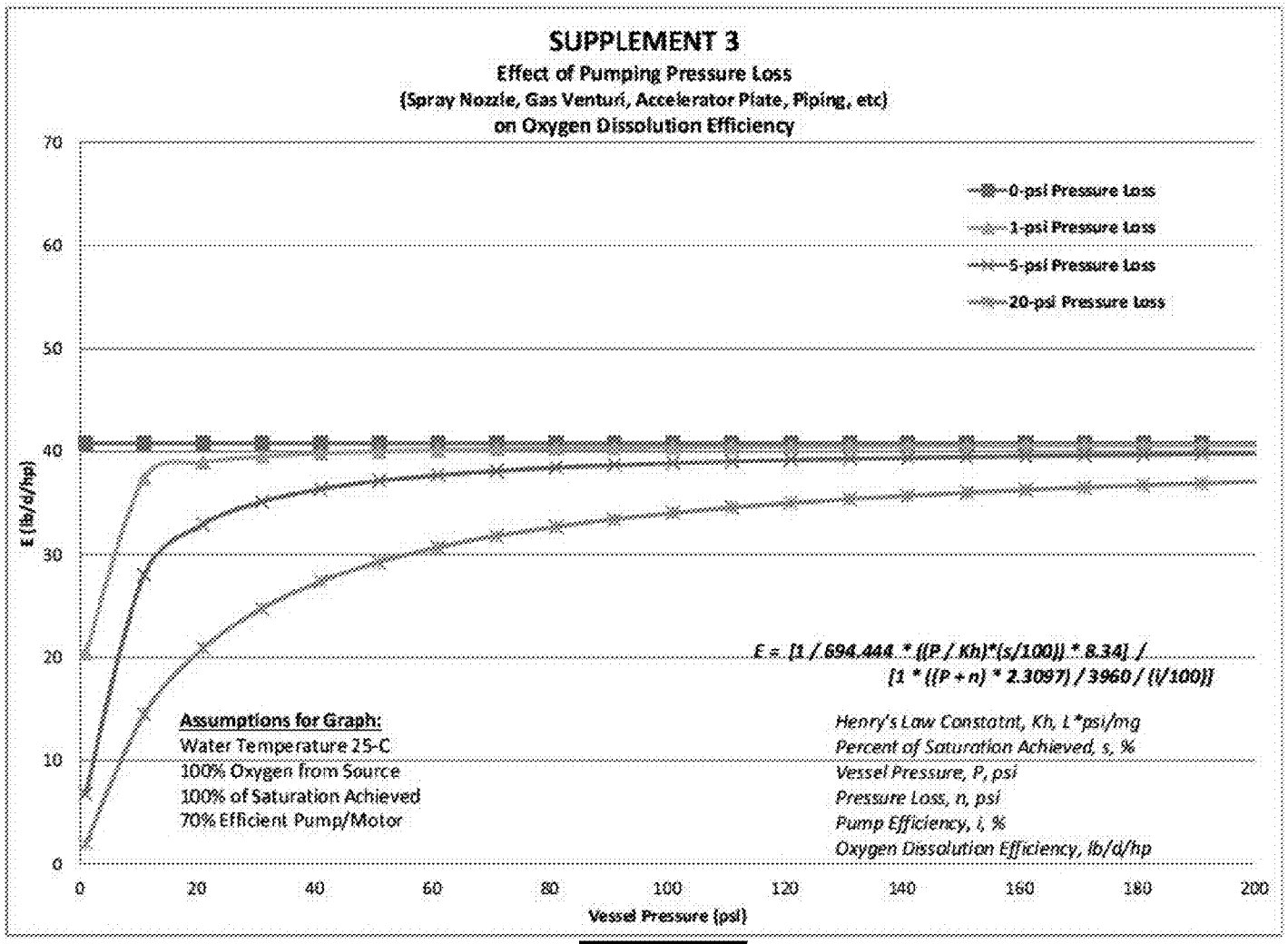
FIG. 10 is a chart showing the effect of pump pressure loss.

See FIG. 8.

Supplement 4

Oxygen Injection Technology Assessment

Oxygen Requirement

Total Delivered=2000.00 lb/d

| Pressurized Spray Sidestream Pumping | | Pressurized Spray - Non-Clog Sidestream Pumping | |
|---|---|---|---|
| E = (1/694.444 * ((P/kh) * (s/100)) * 8.34)/(1 * ((P + L) * 2.3097)/ | | | |

-continued

| | | | |
|---|---|---|---|
| 3960/(i/100)) | | | |
| Kh, L * psi/mg = | 0.35 | Kh, L * psi/mg = | 0.35 |
| Saturation, s, % = | 95.00 | Saturation, s, % = | 75.00 |
| P, psi = | 100.00 | P, psi = | 100.00 |
| Press. Loss, L, psi = | 45.00 | Press. Loss, L, psi = | 15.00 |
| Pump Eff, i, % = | 75.00 | Pump Eff, i, % = | 75.00 |
| E, lb/d/hp = | 28.91 | E, lb/d/hp = | 28.78 |
| hp = | 69 | hp = | 70 |
| kw = | 51.6 | kw = | 51.8 |
| Oxygen Generation | | Oxygen Generation | |
| Fp = 140.66 * P^(−1.106) | | | |
| P, psi = | 100.00 | P, psi = | 100.00 |
| Fp, lb/d/kw/psi = | 0.86 | Fp, lb/d/kw/psi = | 0.86 |
| E, lb/d/kw = | 86.33 | E, lb/d/kw = | 86.33 |
| kw = | 23.2 | kw = | 23.2 |
| Total | | Total | |
| Total, kw = | 74.8 | Total, kw = | 75.0 |

| Downflow Bubble Contactor Sidestream Pumping | | Dowflow Bubble- Venturi Sidestream Pumping | |
|---|---|---|---|
| Kh, L * psi/mg = | 0.35 | Kh, L * psi/mg = | 0.35 |
| Saturation, s, % = | 90.00 | Saturation, s, % = | 90.00 |
| P, psi = | 50.00 | P, psi = | 50.00 |
| Press. Loss, L, psi = | 15.00 | Press. Loss, L, psi = | 25.00 |
| Pump Eff, i, % = | 75.00 | Pump Eff, i, % = | 75.00 |
| E, lb/d/hp = | 30.55 | E, lb/d/hp = | 26.47 |
| hp = | 65 | hp = | 76 |
| kw = | 48.8 | kw = | 56.3 |
| Oxygen Generation | | Oxygen Generation | |
| P, psi = | 50.00 | P, psi = | 1.00 |
| Fp, lb/d/kw/psi = | 1.86 | Fp, lb/d/kw/psi = | 140.66 |
| E, lb/d/kw = | 92.91 | E, lb/d/kw = | 140.66 |
| kw = | 21.5 | kw = | 14.2 |
| Total | | Total | |
| Total, kw = | 70.3 | Total, kw = | 70.5 |

| Venturi Injection Sidestream Pumping | | Present Invention Sidestream Pumping | |
|---|---|---|---|
| Kh, L * psi/mg = | 0.35 | Kh, L * psi/mg = | 0.35 |
| Saturation, s, % = | 95.00 | Saturation, s, % = | 100.00 |
| P, psi = | 100.00 | P, psi = | 0.00 |
| Press. Loss, L, psi = | 20.00 | Press. Loss, L, psi = | 0.00 |
| Pump Eff, i, % = | 75.00 | Pump Eff, i, % = | 75.00 |
| E, lb/d/hp = | 34.93 | E, lb/d/hp = | 500.00 |
| hp = | 57 | hp = | 4 |
| kw = | 42.7 | kw = | 3.0 |
| Oxygen Generation | | Oxygen Generation | |
| P, psi = | 1.00 | P, psi = | 100.00 |
| Fp, lb/d/kw/psi = | 140.66 | Fp, lb/d/kw/psi = | 0.86 |
| E, lb/d/kw = | 140.66 | E, lb/d/kw = | 86.33 |
| kw = | 14.2 | kw = | 23.2 |
| Total | | Total | |
| Total, kw = | 56.9 | Total, kw = | 26.1 |

Supplement 5.1a

Example Sizing Calculations

Reactor Properties

Total Height (in)=60

Diameter (in)=30

Area ($ft^2$)=4.9

Volume ($ft^3$)=24.5

1/10 Volume ($ft^3$)=2.5

Inlet Outlet Sizing/Flow Rate z1+v1^2/(2*g)=z2+v2^2/(2*g)+L z1=v2^2/(2*g)+L v2=[(z1−L)*(2*g)]^0.5

Driving Head, z1 (ft)=1

Head Loss, L (ft)=0.5

Gravity, g ($ft/s^2$)=32.2

Velocity, v2, (ft/s)=5.7

Inlet Diameter (in)=6
Area ($ft^2$)=0.20
Flow ($ft^3/s$)=1.1
Flow (gpm)=500
Q=C*A*(2*g*h)*0.5
Coefficient, C=0.65
Area ($ft^2$)=0.20
Gravity, g ($ft/s^2$)=32.2
Driving Head, z1 (ft)=1
Flow, Q ($ft^3/s$)=1.0
Flow (gpm)=460 8%
System Timing (Batch)
Liquid In Reactor (%)=80%
Liquid Volume ($ft^3$)=19.6
Liquid Flow ($ft^3/s$)=1.0
Fill Time (s)=19
Gas in Reactor (%)=20%
Gas Volume ($ft^3$)=19.6
Gas Flow (scfm)=30
Pressure Time (s)=39
Supplement 5.1b
Example Batching Operations

| Time (s) | Reactor 1 | Reactor 2 | Reactor 3 |
|---|---|---|---|
| 0 | fill | discharge | pressure |
| 5 | fill | discharge | pressure |
| 10 | fill | discharge | pressure |
| 15 | fill | discharge | pressure |
| 20 | pressure | fill | discharge |
| 25 | pressure | fill | discharge |
| 30 | pressure | fill | discharge |
| 35 | pressure | fill | discharge |
| 40 | pressure | pressure | fill |
| 45 | pressure | pressure | fill |
| 50 | pressure | pressure | fill |
| 55 | pressure | pressure | fill |
| 60 | discharge | pressure | pressure |
| 65 | discharge | pressure | pressure |
| 70 | discharge | pressure | pressure |
| 75 | discharge | pressure | pressure |

Supplement 5.2a
Method/Apparatus for Dissolving Gases in Liquids
Example Sizing Calculations
Reactor Properties
Total Height (in)=60
Diameter (in)=30
Area ($ft^2$)=4.9
Volume ($ft^3$)=24.5
1/10 Volume ($ft^3$)=2.5
Inlet Outlet Sizing/Flow Rate
z1+v1^2/(2*g)=z2+v2^2/(2*g)+L
z1=v2^2/(2*g)+L
v2=[(z1−L)*(2*g)]^0.5
Driving Head, z1 (ft)=1
Head Loss, L (ft)=0.5
Gravity, g ($ft/s^2$)=32.2
Velocity, v2, (ft/s)=5.7
Inlet Diameter (in)=4
Area ($ft^2$)=0.09
Flow ($ft^3/s$)=0.5
Flow (gpm)=222
Q=C*A*(2*g*h)*0.5
Coefficient, C=0.65
Area ($ft^2$)=0.09
Gravity, g ($ft/s^2$)=32.2
Driving Head, z1 (ft)=1
Flow, Q ($ft^3/s$)=0.5
Flow (gpm)=204 8%
System Timing (Batch)
Liquid In Reactor (%)=80%
Liquid Volume ($ft^3$)=19.6
Liquid Flow ($ft^3/s$)=0.5
Fill Time (s)=43
Gas in Reactor (%)=20%
Gas Volume ($ft^3$)=19.6
Gas Flow (scfm)=12
Pressure Time (s)=98
Supplement 5.2b
Example Batching Operations

| Time (s) | Reactor 1 | psi | Reactor 2 | psi | Reactor 3 | psi | Reactor 4 | psi |
|---|---|---|---|---|---|---|---|---|
| 0 | fill | 0 | discharge | 100 | pressure | 56 | pressure | 0 |
| 5 | fill | 0 | discharge | 88 | pressure | 61 | pressure | 6 |
| 10 | fill | 0 | discharge | 75 | pressure | 67 | pressure | 11 |
| 15 | fill | 0 | discharge | 63 | pressure | 72 | pressure | 17 |
| 20 | fill | 0 | discharge | 50 | pressure | 78 | pressure | 22 |
| 25 | fill | 0 | discharge | 38 | pressure | 83 | pressure | 28 |
| 30 | fill | 0 | discharge | 25 | pressure | 89 | pressure | 33 |
| 35 | fill | 0 | discharge | 13 | pressure | 94 | pressure | 39 |
| 40 | fill | 0 | discharge | 0 | pressure | 100 | pressure | 44 |
| 45 | pressure | 0 | fill | 0 | discharge | 100 | pressure | 50 |
| 50 | pressure | 6 | fill | 0 | discharge | 88 | pressure | 56 |
| 55 | pressure | 11 | fill | 0 | discharge | 75 | pressure | 61 |
| 60 | pressure | 17 | fill | 0 | discharge | 63 | pressure | 67 |
| 65 | pressure | 22 | fill | 0 | discharge | 50 | pressure | 72 |
| 70 | pressure | 28 | fill | 0 | discharge | 38 | pressure | 78 |
| 75 | pressure | 33 | fill | 0 | discharge | 25 | pressure | 83 |
| 80 | pressure | 39 | fill | 0 | discharge | 13 | pressure | 89 |
| 85 | pressure | 44 | fill | 0 | discharge | 0 | pressure | 94 |
| 90 | pressure | 50 | pressure | 0 | fill | 0 | pressure | 100 |
| 95 | pressure | 56 | pressure | 6 | fill | 0 | discharge | 100 |
| 100 | pressure | 61 | pressure | 11 | fill | 0 | discharge | 88 |
| 105 | pressure | 67 | pressure | 17 | fill | 0 | discharge | 75 |
| 110 | pressure | 72 | pressure | 22 | fill | 0 | discharge | 63 |
| 115 | pressure | 78 | pressure | 28 | fill | 0 | discharge | 50 |
| 120 | pressure | 83 | pressure | 33 | fill | 0 | discharge | 38 |
| 125 | pressure | 89 | pressure | 39 | fill | 0 | discharge | 25 |
| 130 | pressure | 94 | pressure | 44 | fill | 0 | discharge | 13 |
| 135 | pressure | 100 | pressure | 50 | pressure | 0 | discharge | 0 |

-continued

| Time (s) | Reactor 1 | psi | Reactor 2 | psi | Reactor 3 | psi | Reactor 4 | psi |
|---|---|---|---|---|---|---|---|---|
| 140 | discharge | 100 | pressure | 56 | pressure | 6 | fill | 0 |
| 145 | discharge | 88 | pressure | 61 | pressure | 11 | fill | 0 |
| 150 | discharge | 75 | pressure | 67 | pressure | 17 | fill | 0 |
| 155 | discharge | 63 | pressure | 72 | pressure | 22 | fill | 0 |
| 160 | discharge | 50 | pressure | 78 | pressure | 28 | fill | 0 |
| 165 | discharge | 38 | pressure | 83 | pressure | 33 | fill | 0 |
| 170 | discharge | 25 | pressure | 89 | pressure | 39 | fill | 0 |
| 175 | discharge | 13 | pressure | 94 | pressure | 44 | fill | 0 |
| 180 | discharge | 0 | pressure | 100 | pressure | 50 | fill | 0 |

What is claimed is:

1. A system for dissolving a gas into a liquid, comprising:

a pressure vessel defining an internal chamber configured to hold a liquid and to provide a gas head space above the liquid, the pressure vessel also defining a liquid inlet and a liquid outlet;

a liquid inlet pipe in selective fluid communication with the liquid inlet of the pressure vessel through a liquid control valve;

a liquid source in selective fluid communication with the liquid inlet pipe of the pressure vessel to supply liquid at atmospheric pressure to the internal chamber;

a gas inlet device disposed within the internal chamber of the pressure vessel and configured to allow gas to enter the pressure vessel;

a gas source in selective fluid communication with the gas inlet device and the internal chamber of the pressure vessel through a gas control valve to supply a pressurized gas to the pressure vessel to pressurize the internal chamber and dissolve at least a portion of the gas into the liquid; and an outlet pipe in selective fluid communication with the liquid outlet through a liquid outlet valve for discharging pressurized and gasified liquid from the internal chamber of the pressure vessel, wherein gas pressure resulting from the supply of the pressurized gas both facilitates the dissolving of the gas in the liquid and forces the liquid out of the pressure vessel when the liquid is exposed to the gas pressure and the liquid outlet valve is open.

2. The system of claim 1, wherein the gas inlet device is configured to introduce pressurized gas into the liquid.

3. The system of claim 2, wherein the surface area of the gas inlet device is at least half of the surface area of a bottom of the pressure vessel.

4. The system of claim 1, further comprising an energy recovery device, wherein the energy recovery device is associated with at least one of the liquid inlet and the liquid outlet of the pressure vessel.

5. The system of claim 4, wherein the energy recovery device is a micro-turbine.

6. The system of claim 1, wherein the outlet pipe and the inlet pipe are the same pipe and the liquid inlet and the liquid outlet valve are the same valve.

7. The system of claim 1, further comprising a plurality of pressure vessels connected in a series and configured to supply a constant flow output.

8. The system of claim 7, further comprising an energy recovery device connected to at least one of the plurality of pressure vessels.

9. The system of claim 1, further comprising a control system, wherein the control system is configured to:

open the liquid inlet valve to allow liquid to flow into the internal chamber until a first predetermined condition occurs;

open the gas control valve after closing the liquid inlet valve to pressurize the internal chamber with the gas until a second predetermined condition occurs; and open the liquid outlet valve to effuse the liquid from the internal chamber.

10. The system of claim 9, wherein the first predetermined condition includes at least one of a time or a fill level of the internal chamber.

11. The system of claim 9, wherein the second predetermined condition includes at least one of a time, a pressure of the internal chamber, a dissolution rate of the gas into the liquid, or a gas content of the liquid.

12. The system of claim 1, further comprising a venturi disposed in fluid communication with the liquid outlet pipe and configured to add the gas from the gas head space to an outlet flow.

13. A system, comprising:

a floating vessel including a submerged portion configured to sit below a water level of a body of water; and a pressure vessel disposed within the submerged portion and defining an internal chamber configured to hold a liquid and to provide a gas head space above the liquid, the pressure vessel also defining a liquid inlet and a liquid outlet;

a liquid inlet, pipe in selective fluid communication with the liquid inlet of the pressure vessel through a liquid control valve;

a liquid source in selective fluid communication with the liquid inlet pipe of the pressure vessel to supply liquid at atmospheric pressure to the internal chamber;

a gas inlet device disposed within the internal chamber of the pressure vessel and configured to allow gas to enter the pressure vessel;

a gas source in selective fluid communication with the gas inlet device and the internal chamber of the pressure vessel through a gas control valve to supply a pressurized gas to the pressure vessel to pressurize the internal chamber and dissolve at least a portion of the gas into the liquid; and an outlet pipe in selective fluid communication with the liquid outlet through a liquid outlet valve for discharging the pressurized and gasified liquid from the internal chamber of the pressure vessel, wherein gas pressure resulting from the supply of the pressurized gas both facilitates the dissolving of the gas in the liquid and forces the liquid out of the pressure vessel when the liquid is exposed to the gas pressure and the liquid outlet valve is open.

14. The system of claim 13, wherein the gas source is also disposed within the submerged portion of the floating vessel.

15. The system of claim 13, wherein the submerged portion connects the liquid inlet of the pressure vessel to the body of water.

* * * * *